United States Patent [19]

Bornhorst

[11] Patent Number: 4,972,306

[45] Date of Patent: Nov. 20, 1990

[54] COMPACT VARIABLE DIFFUSER FOR USE IN A LUMINAIRE

[75] Inventor: James M. Bornhorst, De Soto, Tex.

[73] Assignee: Vari-Lite, Inc., Dallas, Tex.

[21] Appl. No.: 300,500

[22] Filed: Jan. 23, 1989

[51] Int. Cl.[5] ..... F21V 11/18

[52] U.S. Cl. ..... 362/278; 362/281; 362/331

[58] Field of Search ..... 362/277, 278, 279, 280, 362/281, 318, 320, 16, 17, 18, 268, 282, 283, 284, 322, 324, 331

[56] References Cited

U.S. PATENT DOCUMENTS

| | | | |
|---|---|---|---|
| 1,654,873 | 1/1928 | Greenewalt | 362/283 |
| 1,773,524 | 8/1930 | Doyle | 362/278 |
| 2,301,419 | 11/1942 | Lew | 362/280 |
| 2,659,038 | 11/1953 | Heyer | 315/316 |
| 3,011,388 | 12/1961 | Baumbach et al. | 88/14 |
| 3,083,293 | 3/1963 | Fandrey | 362/277 |
| 3,308,872 | 3/1967 | Smith | 362/278 |
| 3,338,132 | 8/1967 | Ruhle et al. | 362/277 |
| 3,484,599 | 12/1969 | Little | 362/268 |
| 3,492,070 | 1/1970 | Zahn | 355/37 |
| 3,818,216 | 6/1974 | Larraburu | 240/41.3 |
| 3,883,243 | 5/1975 | Weisglass et al. | 355/35 |
| 4,037,097 | 7/1977 | Stillman et al. | 240/3.1 |
| 4,066,884 | 1/1978 | Taylor | 362/18 |
| 4,104,707 | 8/1978 | Schneider | 362/18 |
| 4,175,279 | 11/1979 | Asaki | 362/18 |
| 4,233,651 | 11/1980 | Fabbri | 362/331 |
| 4,242,723 | 12/1980 | Fabbri et al. | 362/331 |
| 4,323,955 | 4/1982 | Mark | 362/278 |
| 4,333,127 | 6/1982 | Alkema et al. | 362/18 |
| 4,392,187 | 7/1983 | Bornhorst | 362/233 |
| 4,591,955 | 5/1986 | Kallay | 362/320 |
| 4,602,321 | 7/1986 | Bornhorst | 362/268 |
| 4,618,918 | 10/1986 | Zhabokrug | 362/283 |
| 4,775,918 | 10/1988 | Snyder | 362/281 |
| 4,800,474 | 1/1989 | Bornhorst | 362/281 |
| 4,843,528 | 6/1989 | Pearce-Harvey et al. | 362/277 |

OTHER PUBLICATIONS

ColorMax Brochure, PUB 1981.

"The Perfect Club Mixer . . . Crystal Color" by Artifex Corporation, 11/88.

*Primary Examiner*—Ira S. Lazarus

*Assistant Examiner*—Richard R. Cole

*Attorney, Agent, or Firm*—Richards, Medlock & Andrews

[57] ABSTRACT

A tambour-type panel of sections movable in a U-shaped track system from a side location in a housing to a location in the path of light. The panel sections are constructed to diffuse light passing therethrough. Each section of the diffusing panel has a texturing which diffuses the light with different degrees.

28 Claims, 3 Drawing Sheets

FIG. 1
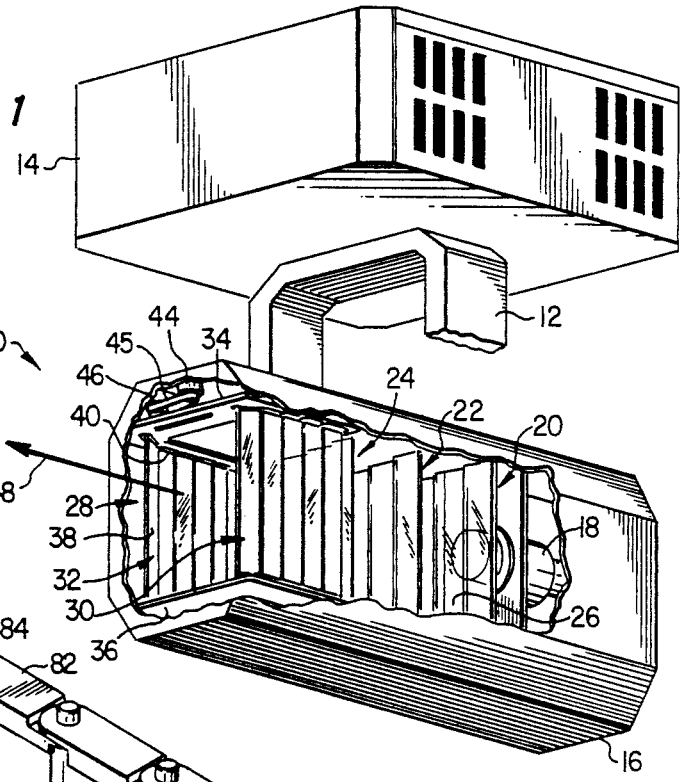
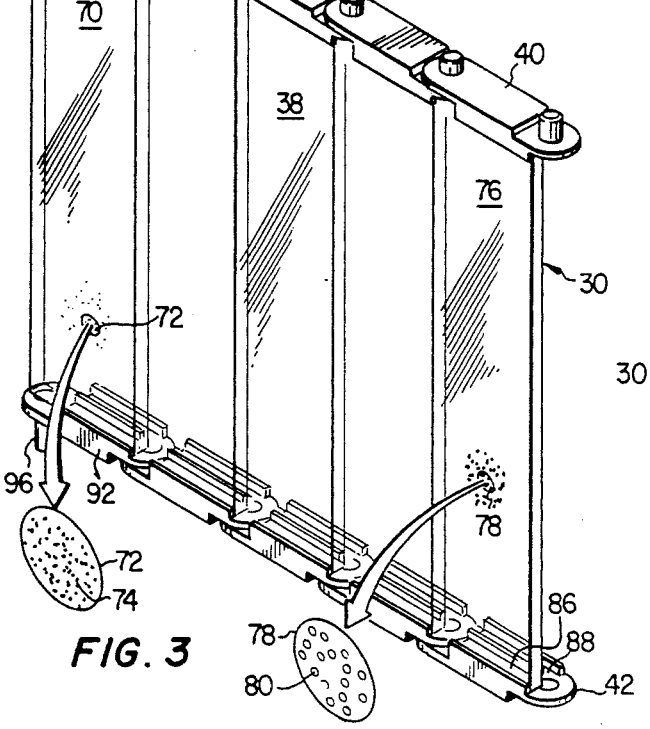
FIG. 3
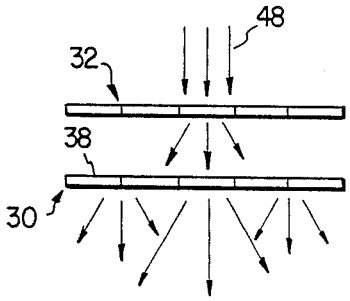
FIG. 3a

COMPACT VARIABLE DIFFUSER FOR USE IN A LUMINAIRE

BACKGROUND OF THE INVENTION

Luminaires have long been used in the entertainment area and other fields to produce dramatic lighting effects on a subject matter. In the theatrical field, many types of luminaires are utilized to provide a variety of effects on the actors, musicians, scenery, etc. For example, spot luminaires are employed to produce a bright and intense beam of light with a finely defined peripheral edge. Wash luminaries are utilized to produce a soft and ill-defined beam of light for flooding a general area, such as the background of a stage. Literally hundreds of such lights are utilized in large performances, such as rock concerts. U.S. Pat. No. 4,392,187 illustrates a highly sophisticated and computerized lighting system well adapted for providing many types of lighting effects.

The trend in developing high performance luminaires is toward microprocessor controlled units having motorized apparatus for altering the properties of the light. Such units include lenses, color changers, dowsers, dimmers, diffusers, as well as power supplies and mechanical apparatus for providing pan and tilt orientations to the luminaire. Owing to the number of components required to produce the various lighting effects, the size and weight of sophisticated luminaires tends to increase. The apparatus for altering the properties of a light beam often include mechanisms for inserting and removing glass panels from the path of the light to create the desired effect. For example, colored panels, such as those disclosed in the patent noted above, as well as in U.S. Pat. No. 4,037,097, are used with stepmotors for rotating the color panels in a beam of light to change the hue and saturation properties of the light. Also shown in U.S. Pat. No. 4,392,187, are individual panels which can be pivotally mounted to operate as shutters within the path of the light to thereby produce a desired color. In addition, such panels have been constructed of a textured glass to produce a diffused light beam.

In the stage performance field, it is also required to often produce a diffuse light beam, such as by the noted wash luminaires to illuminate a broad area. A Fresnel luminaire can product such an effect, using lenses with highly textured surfaces to produce the diffuse light. However, the amount of diffusion of the light is difficult to adjust and is usually provided by manual adjustable apparatus. It can be appreciated that such a manual adjustment is often difficult, especially when such a lamp is mounted to an overhead truss frame. Also, other types of light diffusing apparatus are available, but either requires a substantial amount of space in the luminaire housing, is heavy and bulky, or remains within the path of light even if deactivated, or is degraded over time by the light beam. Techniques often used in the art involve the hinging or swinging of a light altering panel of glass into the path of light, and then out of the path when not used. This approach is effective to produce the intended purpose, but requires substantial space to allow the full arcuate swing of the panel.

The color-changing mechanism shown in U.S. Pat. No. 4,602,321 has been used effectively in the VL3 wash luminaire made by Vari-Lite, Inc. of Dallas, Texas, and has been adapted to carry panels of textured, translucent glass which pivot within the path of a light beam and thereby diffuse the beam. It has been discovered by experience that the variable diffuser utilizing pivotable glass panels works best only at the two extremes of travel: fully open or fully closed. This is due to several factors, one of which is that only one type of glass is used in all three panels, yielding three diffuse blobs growing within a field of intense light as the panels are rotated. White light escaping between the partially rotated panels, while quite effective in reducing saturation of a colored beam in a color changer, creates a noticeable pattern of light when used in a pivoting glass diffuser. Once the panels are rotated far enough to completely overlap the entire beam, the diffusion effect almost reaches its maximum level. Further rotation produces only minimal additional diffusion.

It can be seen from the foregoing that a need exists for an improved light altering mechanism which is lightweight, requires little space, and which can be moved entirely out of the path of the beam of light. A further need exists for a mechanism which can be employed in luminaires for moving light altering panels to varying locations within the path of the light to achieve a desired effect, and then move such panels entirely from the light path, into an area in the housing which is normally not used.

SUMMARY OF THE INVENTION

The panel moving apparatus according to the invention reduces or substantially eliminates the shortcomings and disadvantages of prior methods and equipment. According to the panel moving apparatus of the invention, there is disclosed a tambour mechanism for moving a linked number of individual light altering panel sections from opposing sides of a luminaire housing, to varying positions within the light path. The panel sections move along a curved track system so that a leading of each tambour-type panel can close together in the light path, and can even overlap so as to provide further alteration of the light, such as a higher degree of diffusing.

According to the preferred embodiment of the invention, each section of the tambour panel is constructed having a light diffusion property which is different than adjacent sections. The panel sections near the leading edge of the tambour panel diffuse the light to a lesser degree than the sections situated near the trailing end of the tambour panel.

Diffusing sections are connected together as two panels which are each connected at upper and lower edges thereof to respective linked chains which engage corresponding upper and lower tracks so that the tambour panel can be moved from opposing side positions along the housing to positions transverse to the light path. A step-type motor and cog belt are employed to move the tambour panels along the track system to any desired position.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts or elements throughout the views, and in which:

FIG. 1 is an isometric view of a luminaire embodying the tambour panel of the invention;

FIG. 3 is an isometric view of one panel of the tambour type diffuser of the invention;

FIG. 3*a* illustrates the double diffusion of light through the overlapping tambour panels;

DETAILED DESCRIPTION OF THE INVENTION

Figure 4:
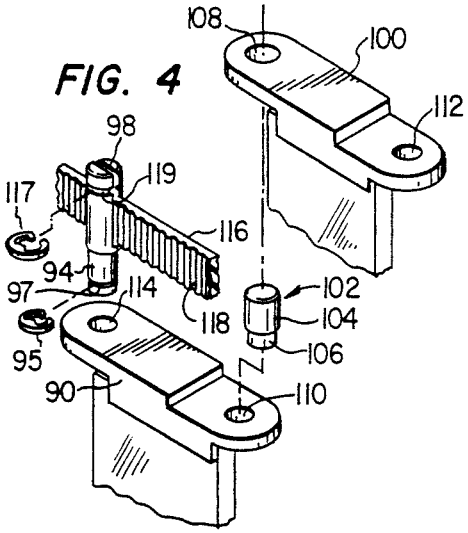
FIGS. 4 and 5 illustrate the details of the linked chain for attachment of the panel sections together.

While there exists many applications for the invention, FIG. 1 illustrates one application in which the invention may be advantageously practiced. Shown is a luminaire 10 pivotally fixed about a vertical axis by a hollow yoked member 12 to a base 14. The yoked member 12 is pivotally fixed about a horizontal axis to a housing 16, the overall arrangement providing pan and tilt movements of the luminaire 10 with respect to the base 14. The construction of the housing of the luminaire 10 is disclosed in more detail in U.S. Pat. No. 4,701,833 assigned to Vari-Lite, Inc. Typical applications of the luminaire require the base 14 to be fixed to a truss or frame structure (not shown) which is elevated above the stage or area in which the performance is to be conducted.

The housing 16 of the luminaire 10 includes a number of components which produce the varied lighting effects. In addition, and not shown, the housing 16 may include circuit boards, motor controls, and a high wattage lamp 18 functioning as the source of light. A color generation assembly, including a first color section 20, and a second color section 22, and a third color section 24 is employed, each having a number of dichroic filters, such as 26. Each dichroic color section includes three dichroic filters which are rotatable in unison to provide a band pass of different colors. The color generation assembly is described in more detail in U.S. Pat. No. 4,602,321, assigned to Vari-Lite, Inc., Dallas, Texas. A typical luminaire 10 may include many other components not shown for reasons of clarity.

The luminaire 10 constructed according to the preferred embodiment of the invention includes a variable light diffuser 28 constructed to occupy space not normally used by other components within the housing 16. The variable diffuser 28 can be moved from a position on the sides of the housing 16 to a position within the path of light generated by the lamp 18. The variable diffuser 28 according to the invention includes a first tambour-type diffusing panel 30 and a second similar diffusing panel 32, each movably mounted between a top track 34 and a bottom track 36. The tracks 34 and 36 are fixed internally to the housing 16, and preferably, although not of necessity, in the frontal part of the housing 16.

Each diffusing panel 30 and 32 includes a number of individual sections, such as 38, each being fixed to an upper chain link 40 (FIG. 3) and a lower link 42 to form respective drive chains adapted for moving within the top and bottom tracks 34 and 36. Further provided is a motor 44, preferably of the stepper type, connected by a belt 45 (FIG. 6) to a reduction pulley 46, and therethrough to the linked upper and lower drive chains. With this construction, each diffusing panel 30 and 32 can be moved by the motor 44 along the tracks to positions on opposing sides of the housing 16 to completely remove the diffusing elements out of the path of the light as indicated by arrow 48.

When it is desired to diffuse the light emitted from the lamp 18, the motor 44 is energized, or stepped, whereby both diffusing panels 30 and 32 move along the tracks 34 and 36 and into the light path 48. The light is thereby diffused to an extent by which the diffusing panels 30 and 32 are moved into the light path 48. Those skilled in the art will appreciate that as the leading edge of each diffusing panel 30 and 32 begins to move into the light path 48, the light becomes diffused. As the diffusing panels 30 and 32 are moved completely into the light path 48, in a frontal edge to frontal edge relationship, the light path is entirely intercepted by the diffusing panels 30 and 32 so that full light diffusion occurs. However, in accordance with an important feature of the invention, the track system, including upper track 34 and lower track 36, permits the diffusing panels 30 and 32 to be moved into a fully overlapping position in the light path 48 so that the light must pass through both diffusing panels 30 and 32, thereby providing greater diffusion of the light.

When the diffusing panels are moved to an overlapping relationship, such as shown in FIG. 3*a*, a double dispersion of the light is achieved. In other words, when the light 48 generated by the lamp 18 strikes the first diffusing panel 32, it is diffused into a number of dispersed rays. Each such ray then strikes a second diffusing panel 30, wherein each ray is again dispersed. A double dispersing effect is achieved, whereby a greater degree of light dispersion or diffusion of the light beam can be realized.

In accordance with another feature of the invention, each diffusing section 38 for each of the panels 30 and 32 can be constructed to diffuse light in a different amount as the light passes therethrough. For example, the diffusing sections 38 arranged near the leading edge of each diffusing panel 30 and 32 can be finely textured so as to diffuse the light to a lesser degree than other adjacent sections. Those diffusing sections 38 located near the trailing edge of each diffusing panel 30 and 32 can be constructed with more coarse texturing to thereby provide maximum diffusion of the light passing therethrough. In providing a continuum of diffusion capabilities, the diffusing sections 38 intermediate the leading and trailing edges of each such panel 30 and 32 can be constructed with intermediate degrees of texturing to thereby provide an intermediate degree of light diffusion Those skilled in the art can readily appreciate that the type of light diffusing material, and the degree of diffusion thereof, can be varied to suit particular needs. In the preferred form of the invention, the diffusing sections 38 are constructed of glass having surface coatings or textures selected to provide diffusion properties ranging from mild to heavy. Moreover, the invention is not limited to that noted above, but rather the diffusing panels 30 and 32 can be constructed of a flexible plastic so that each such panel can be moved around the corners of the track system without a need for individual tambour sections.

Figure 2:
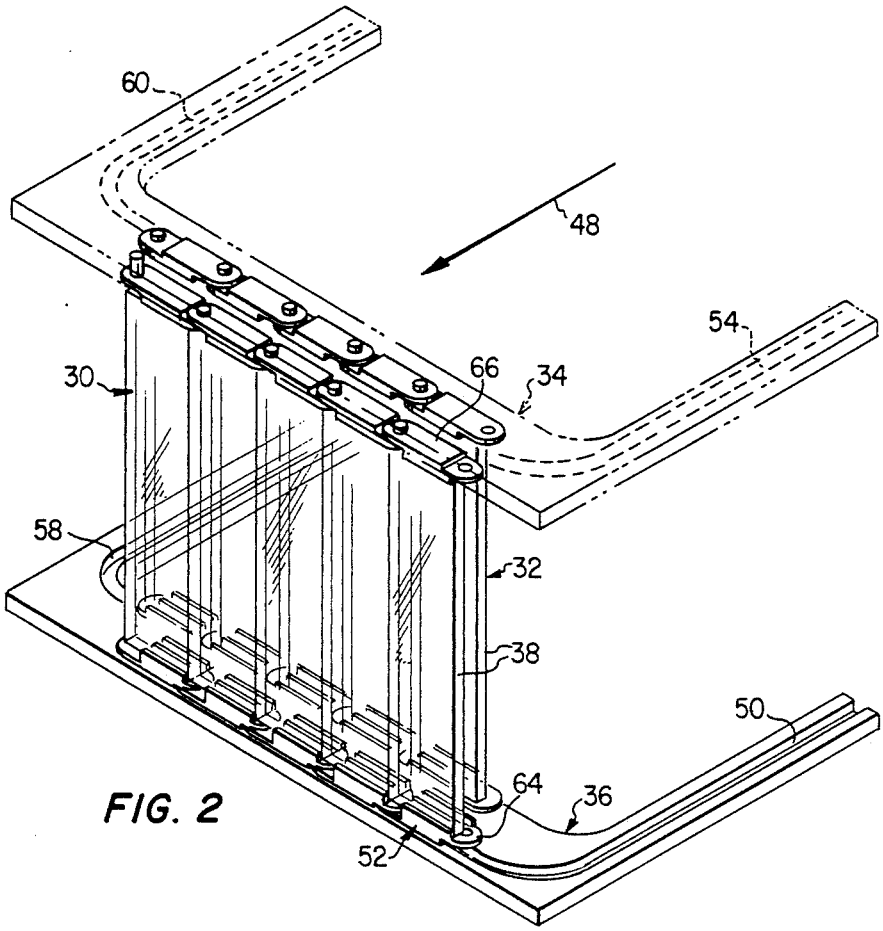
FIG. 2 is an isometric view of the panel track mechanism according to the invention.

With reference now to FIG. 2, there are illustrated the details of the variable light diffuser of the invention, with the motorized drive mechanism removed for purposes of clarity. The lower track 36 includes a groove 50 adapted for engaging with the lower drive chain 52 for guiding the lower edge of the diffusing panel 30 from a position fully within the light path 48, as shown, to a position parallel to the side of the luminaire housing 16. The top track 34 includes a similar groove 54 for guiding the upper part of the diffusing panel 30 between similar positions. The groove 50 in the bottom track 36 and the groove 54 in the top track 34 are formed entirely through such tracks in the frontal areas of the tracks.

Each such track 34 and 36 includes a second pair or grooves 58 and 60 formed in a manner similar to those of grooves 50 and 54. Again, the grooves 58 and 60 are formed entirely through the frontal sections of the respective tracks The purpose of the groove sections formed entirely through the tracks 34 and 36 will be described in detail below.

Each diffusing panel section 38 is fixed in a tambour manner with respect to each other by the respective linked chains so as to be movable around the respective corners of the upper and lower tracks 34 and 36. The diffusing sections 38 of the panel 30 are each connected to a respective lower and upper link, such as links 64 and 66, each link being connected together to a corresponding lower and upper drive chain. While the tambour panels are described herein as being moveable in a track system from opposing side locations, the invention can also be employed for movement from opposing upper and lower locations.

The tambour-type diffusing panel of the invention is more clearly shown in FIG. 3. In the preferred form of the invention, the diffusing sections 38 are constructed with glass which is surface textured to an amount by which it is desired to diffuse the light passing therethrough. As noted above, each section 38 has a different texturing formed on a face surface thereof to diffuse the light in a different amount. Preferably, the leading diffusing section 70 includes a fine texturing 72, also shown as an enlargement thereof. The texturing includes a large number of small surface irregularities 74 such as scratches, dimples or bumps, an etched surface, or other fine texturing formed during the construction of the diffusing section 70. The trailing edge glass diffusing section 76 is characterized by having a coarse texturing 78, also shown by the enlarged view. The coarse texturing can be formed by a smaller number of densely arranged large irregularities 80, such as large dimples or protrusions formed during the construction of the glass diffusing section 76. The diffusing sections located intermediate the leading section 70 and the trailing section 76 are selected with texturing which is intermediate that of the noted sections. In this manner, the amount by which the light is diffused depends upon the amount by which the diffusing panel 32 is moved within the path 48 of the light. While those skilled in the art may find that one such movable panel 32 provides adequate light diffusing capabilities, another similar panel can be employed and moved in overlapping positions to produce yet additional diffusing capabilities.

Each diffusing section 38 is mounted at its upper end thereof to a link 40, and at its lower end thereof to a similar link 42. The links 40 and 42 are joined to other similar links to form respective drive chains which cooperate with the track system to move the diffusing panel 30 from a side location within the housing 16, around a corner, and in a frontal position in the path 48 of the light.

Each chain link is joined to a neighboring link, such as 82 by a pin 84 which allows pivotal movement of one link with respect to the other. In addition, the diffusing section 38 of each panel 30 is mounted to respective upper and lower links by a room temperature vulcanizer (RTV) compound or other similar adhesive material. As noted by the construction of link 42 in FIG. 3, there are provided parallel, side-by-side, channels 86 and 88 in which the diffusing sections are fixed. A pair of channels 86 and 88 are provided so that a single link construction can be employed for both the bottom and top links of each drive chain. When used as a bottom link 42, the diffusing section 76 would be adhered in the frontal channel 86. If used as a top link, such link would be reversed, whereby the diffusing section would be adhered to channel 88 which would then be the frontal channel in the top link. Importantly, the diffusing sections 38 are mounted in the frontal channels of the respective upper and lower chain links to increase the radius of curvature as the tambour arrangement of panel sections is moved around the corner of the respective upper and lower tracks 34 and 36.

The links 90 and 92 to which the leading panel section 70 is mounted each include a drive pin 94 and 96 having respective slots 98 for engaging respective cog drive belts (not shown in FIG. 3). In this manner, the movement of the drive cog belts by the stepper motor is effective to move the panel 30 along the grooves 54 and 50 of the respective upper and lower tracks 34 and 36.

FIG. 4 illustrates two links 90 and 100 forming a portion of the top linked chain, with associated connecting apparatus removed for purposes of clarity. Links 90 and 100 are pivotally fastened to each other by a pin 102 having a larger diameter section 104 and a smaller diameter section 106. The smaller diameter section 106 of pin 102 fits tightly within a hole 110 formed within the link 90. The larger diameter section 104 fits loosely within a hole 108 of the link 100. The top end part of the larger diameter section 104 protrudes through the hole 108 and above the link 100 to provide an end thereof which fits within the groove 54 of the upper track 34. Pivotal movement of the link 90 with respect to the link 100 is occasioned by the larger diameter section 104 rotating within the hole 108 of link 100. It should be noted that for each link, the hole 108 on one end thereof is larger than the hole 112 on the opposing end.

On the end links, such as the leading edge link 90, the drive pin 94 fits tightly within the hole 114 and is secured with an e-clip 95 snapped into an annular groove 97 formed in one end of the drive pin 94. A larger portion of the pin 94 extends upwardly beyond the link 90 and through the track groove formed entirely through a frontal part of the top track 34. On the top side of the track 34, a cogged belt 116 is engaged within the slot 98 of the pin 94. The cogged belt 116 is flat on one side thereof, and has cogs or corrugations 118 on the other side. The slot 98 of the drive pin 94 is similarly constructed, with a flat side and an opposing corrugated side for engaging the corresponding surfaces of the belt 116. With this construction, the belt 116 can be slid into the slot 98 of the drive pin 94 to fix the parts together and prevent slipping. The cogged belt 116 is further fixed within the slot 98 of the pin 94 by an e-clip 117 snapped into an annular groove 119 of the pin 94. When the belt 116 is moved laterally by a drive mechanism, the drive pin 94 and attached link 90 are carried with the belt 116. The various parts of the top linked chain, including the links 90, 100 and the connecting pins 102 and drive pin 94, are constructed of plastic and dimensioned to achieve the various functions noted above.

Figure 5:
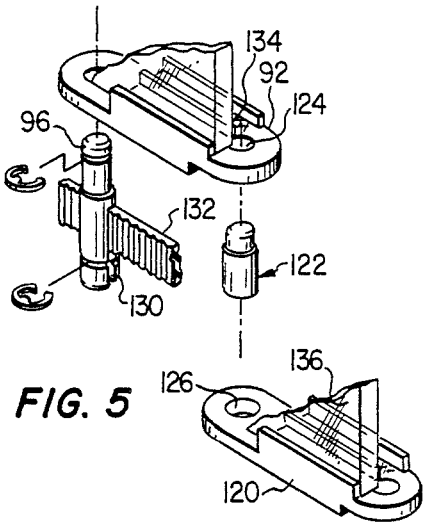

FIG. 5 illustrates the construction of the bottom linked chain. As noted, the bottom links are constructed identical to the top links described above. Bottom link 92 is connected to link 120 by a stepped pin 122 which fits tightly in a hole 124 within link 92, but is rotatable within the larger hole 126 of link 120. A bottom drive pin 96 is fixed within hole 128 of link 92, and has a slotted end 130 for fixing a bottom cogged belt 132 thereto. Thus, lateral movement of the cog belt 132 is effective to move the bottom links of the bottom linked chain. As further noted in FIG. 5, the bottom surfaces of the channels of each link have ridges or grooves 134 which aid in adhesively securing the diffusing sections 136 therein. Both channels of each link, including the top and bottom links of each chain are similarly constructed to provide a high quality bonding of each diffusing section with the channels of the corresponding top and bottom links.

Figure 6:
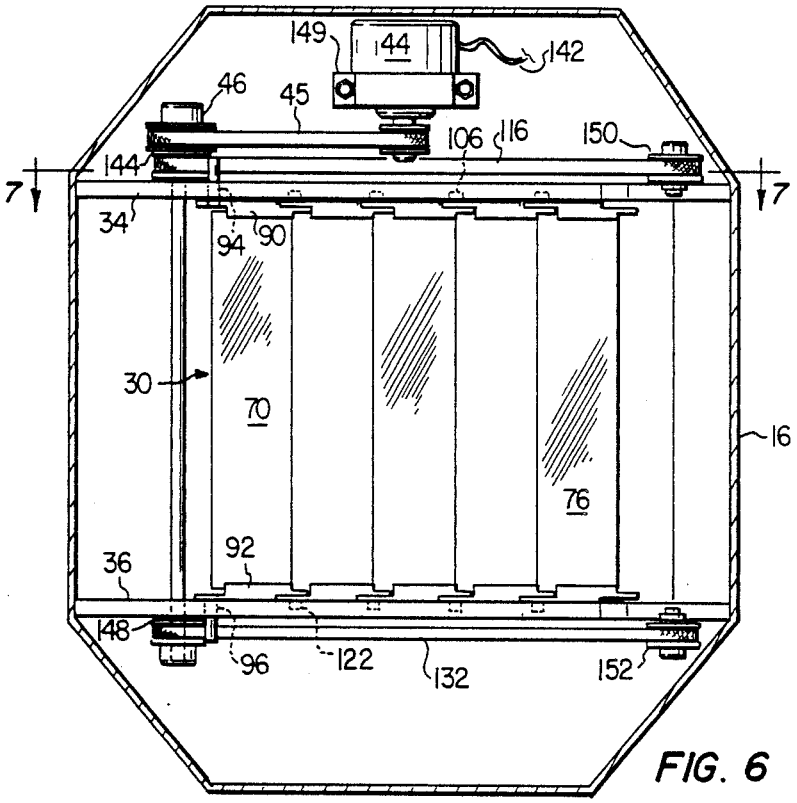
FIG. 6 is a frontal sectional view of a luminaire illustrating the tambour panels in an overlapped position in the path of the light beam.

FIG. 6 illustrates a frontal elevation view of the tambour diffuser of the invention. While not shown, the upper track 34 and lower track 36 are fixed to the housing 16 at the side edges thereof with conventional hardware, such as screws and/or angle brackets. The diffusing panel 30 is shown moved completely into the path of the light, with the other diffusing panel 32 located behind the panel 30. The motor 44 is driven via electrical conductors 142 to move the frontal diffusing panel 30 to the right and along the right-hand side of the housing 16, and to move the other diffusing panel 32 to the left and along the left-hand side of the housing 16. The motor 44 is connected by a cogged belt 45 to a reduction pulley 46. A cogged drive pulley 144 associated with the reduction pulley 46 is fixed by a drive rod 146 to a lower drive pulley 148. The drive pulleys 144 and 148 are journaled for rotation within the respective upper track 34 and lower track 36. The motor 44 is fixed with respect to the upper track 34 by bracket 149. The upper cogged pulley 144 is connected by the cog belt 116 to a cogged idler pulley 150. In like manner, the lower drive pulley 148 is connected by the cogged belt 132 to a lower idler cogged pulley 152. Idler pulleys 150 and 152 are rotatably mounted with respect to the upper track 34 and lower track 36. With this arrangement, when the motor 44 is activated or stepped, the belts 116 and 132 move accordingly. Importantly, a frontal length of each belt 116 and 132 moves to the right, as shown in FIG. 6, while a back portion of the belts move to the left. With the drive pins 94 and 96 of one diffusing panel 30 connected to the frontal length of the belts 116 and 132, and with the drive pins (not shown) of the other diffusing panel 32 connected to the back portion of each belt 116 and 132, the rotation of the motor 44 causes the diffusing panels 30 and 32 to move in opposing directions.

Figure 7:
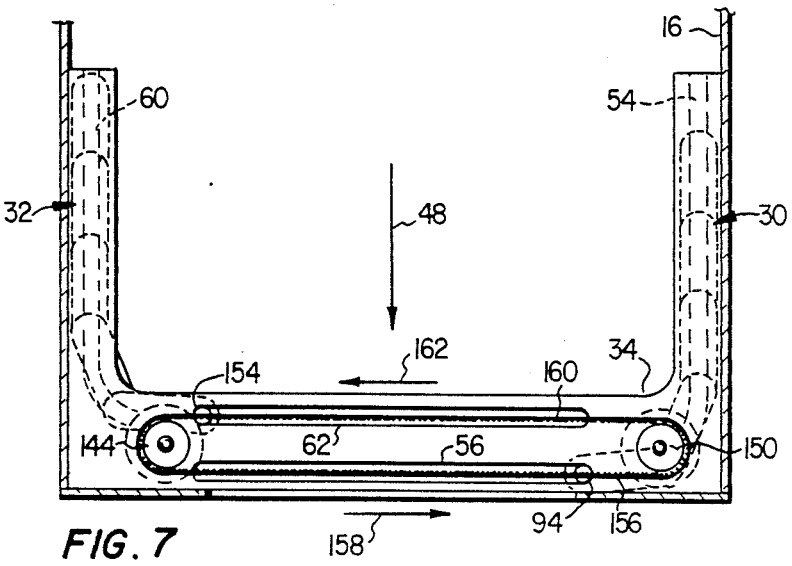
FIG. 7 illustrates the track and drive apparatus of the panel moving mechanism of the invention.

A clearer understanding of the movement of the diffusing panels 30 and 32 in the track system can be obtained from FIG. 7. Here, the diffusing panels 30 and 32 are shown in a retracted position along the opposing sides of the luminaire housing 16. When retracted to such positions by the motor 44, the upper drive pin 94 of panel 30 is in the right-hand end of through slot 56 of the upper track 34, while the top drive pin 154 associated with diffusing panel 32 is at the left end of through slot 62. The pins 154 and 94 are thus captured for movement within the through slots 62 and 56 of the upper track 34. Corresponding panel pins are similarly captured in respective through slots in the lower track 36. The noted positions of the pins were occasioned by the counterclockwise rotation of the motor 44, when viewed from above, after frontal belt portion 156 of upper belt 116 has moved in the direction of arrow 158, and rear belt portion 160 has moved in the direction of arrow 162. As can be appreciated, the diffusing panels 30 and 32 are moved into the light path 48 by stepping or rotating the motor 44 in a clockwise direction so that the upper drive pin 154 of panel 32 moves toward the right-hand end of through slot 62 and the upper drive pin 94 associated with panel 30 moves toward the left-hand end of through slot 56. The lower drive pins (not shown in FIG. 7) are carried by the lower pulleys 148 and 152 and drive belt 132 to ensure equal motion of the upper and lower linked chains and keep the diffuser panels 30 and 32 vertical and parallel, thereby preventing binding of the mechanism.

While the foregoing describes the invention in terms of panel sections having light diffusing properties, such sections can be constructed to alter the light to accentuate or achieve other characteristics. For example, the panel sections can be constructed or coated with a color filtering material to produce a desired color of the light beam. Those skilled in the art will find that the panels of the invention can be fitted with sections which are adapted to alter the light beam in various other manners to achieve a desired effect on the light beam.

From the foregoing, disclosed is a tambour-type diffusing arrangement which is highly effective to diffuse light from varying degrees of very little diffusion at all, to a maximum diffusion. Absolutely no diffusion of the light occurs when the diffusing panels are drawn to the sides of the housing, as absolutely no diffusing structure remains in the path of the light. Maximum diffusion occurs when the diffusing panels are moved in the path of the light in a side-by-side or overlapping position. Light must then pass through both panels which produces a maximum diffusing effect. In addition, varying degrees of light diffusion can be achieved by constructing each of the diffusing panel sections to diffuse the light by a different amount. The track system of the tambour diffusing mechanism is U-shaped to require minimal space within a luminaire housing. A technical advantage of the invention is that each diffusing panel comprising multiple diffusing sections can be moved along the U-shaped track from retracted positions to positions where maximum light diffusion is accomplished. Other luminaire apparatus can be mounted generally within the inner area of the diffusion assembly track system, thereby maximizing the space within the luminaire.

While the preferred and other embodiments of the invention have been disclosed with reference to specific light diffusion apparatus, it is to be understood that many changes in detail may be made as a matter of engineering choices without departing from the spirit and scope of the invention, as defined by the appended claims.

What is claimed is:

1. A method for diffusing light, comprising the steps of:

moving a pair of multi-section light diffusing panels from respective side positions out of a light beam around respective curved corners into respective locations transverse to and in a path of the light; and moving each said multi-section panel where each section diffuses light differently, into overlapping positions in the light beam to achieve a progressively greater degree of diffusion of the light such that double diffusion of the light is obtained.

2. A variable light diffuser, comprising:

at least two diffusing panels, each constructed of a transparent material so that the intensity of the light passing therethrough is not substantially reduced;

each said panel being constructed with material producing varying degrees of light diffusivity at different areas thereof; and means for moving each said panel toward each other in a coordinated manner to any one of a plurality of desired positions in front of a light source to close in on the light beam and change the amount by which the light is diffused as a function of a spacing between a leading edge of each said panel.

3. The variable light diffuser of claim 2, wherein each said diffusing panel is constructed with a low degree of light diffusivity on a respective leading portion thereof which is a first portion of the panel to enter the light path when moved, and a higher degree of light diffusivity on a respective trailing part of each said panel, and intermediate degrees of diffusivity therebetween.

4. The variable light diffuser of claim 2, wherein each said diffusing panel is constructed of a number of individual planar light diffusion sections.

5. The variable light diffuser of claim 4, wherein ones of said sections of each said panel diffuse light passing therethrough with different degrees of diffusion.

6. The variable light diffuser of claim 4, further including a curved track, and further including means for moving said diffusing sections along said track in such a manner that the movement of the panels in the track in one direction increases the degree of light diffusion and movement of the panels in an opposite direction reduces the degree of light diffusion.

7. The variable light diffuser of claim 2, wherein said diffusing panels are movable toward each other in respective linear paths in the light path.

8. The variable diffuser of claim 2, wherein said panels are adapted to move together in an overlapping manner in the path of said light so that double light diffusion can be achieved.

9. The variable diffuser of claim 2, further including a track for moving said panels in a U-shaped path.

10. A system for producing diffused light to a desired degree, comprising:

a housing for mounting therein a lamp which produces a light beam, said housing having an opening in a frontal part thereof through which the light beam exits said housing; and a pair of light diffusing panels mounted in said housing for movement from opposing side locations within said housing toward the frontal part of said housing to intermediate positions in said light path to thereby diffuse the light to an extent by which said panels are moved in the path of said light, and to final overlapping positions toward each other in opposing directions where the light passes through one panel and then through the other panel.

11. The light system of claim 10, wherein each said panel comprises a number of individual sections mounted together in an edge-to-edge manner so as to be movable in a curved path between said side positions and said final positions.

12. The light system of claim 11, wherein each said section of a panel has a different light diffusing property.

13. A method for diffusing light, comprising the steps of:

moving a pair of light diffusing panels between respective initial positions out of a light beam in a curvilinear path into respective final overlapping positions in a path of the light to achieve a desired degree of light diffusion;

moving each said panel in said curvilinear path so that a frontal edge of each said light diffusing panel moves toward each other and is spaced apart on opposing sides of the light beam to achieve an intermediate degree of light diffusion; and moving each said panel into overlapping positions in the light beam to achieve a progressively greater degree of diffusion of the light such that double diffusion of the light is obtained.

14. The method of claim 13, further including simultaneously moving each said panel in a forwardly direction in a U-shaped curvilinear path and then reversing the direction of movement of each said panel.

15. The method of claim 13, further including moving a pair of multi-section panels each having multiple sections, in a forward direction, around a respective curved corner from a side location out of the path of the light beam, and then to respective transverse locations in the path of the light beam.

16. The method of claim 14, further including moving each said panel where the sections of each panel have a different degree of diffusion to said light.

17. The method of claim 13, further including moving transparent diffusing panels into the path of the light so that the intensity of the light remains substantially unchanged bu the diffusion thereof is increased.

18. The method of claim 13, further including moving said panels in unison to any one of a plurality of locations with respect to the light beam to achieve a corresponding plurality of degrees of light diffusion.

19. A luminaire for carrying out the method of claim 13.

20. A variable light diffuser, comprising:

a pair of diffusing panels, each constructed of a transparent material so that the intensity of the light passing therethrough is not substantially reduced;

each said panel being constructed so as to have different areas thereon which diffuse light with varying degrees; and means for moving said panels toward each other to desired positions in front of a light source to change the amount by which the light is diffused, and in overlapping positions so that double light diffusion can be achieved without substantially changing the light intensity.

21. The variable diffuser of claim 20, wherein each said panel has varying degrees of diffusivity on surface areas thereof so that when said panels are moved in overlapping positions, areas of low diffusivity of one panel are aligned in a light path with areas of high diffusivity of the other panel.

22. A system for producing diffused light to a desired degree, comprising:

a housing for mounting therein a lamp which produces a light beam;

a pair of light altering panels mounted for movement from opposing side locations along said housing to intermediate positions in the light path to thereby diffuse the light to an extent by which said panels are moved in the path of the light, and to final overlapping positions where the light passes through one panel and then through the other panel;

each said panel comprising a number of individual sections mounted together so as to be movable in a curved path between said side positions and said final positions; and each said section of a panel having a different light diffusing property.

23. The light system of claim 22, wherein each said panel comprises transparent material which does not substantially reduce the intensity of light passing therethrough, and means formed on said transparent material for diffusing the light.

24. The light system of claim 22, wherein each said section of a panel diffuses light to a different degree, and said sections of each panel are arranged so that when moved into overlapping positions, the light which passes through both panels is diffused in a uniform manner.

25. A system for producing diffused light, comprising:

a housing for holding a number of components for altering characteristics of light produced by the system; said housing having a frontal end with an opening through which a light beam is emitted;

a lamp held within said housing for generating light carried in a path toward the opening in the housing;

a color changer held within said housing for altering the color of light emitted from the opening in the housing;

a light diffuser held within said housing for diffusing light emitted from the opening in the housing a desired amount, said diffuser comprising a U-shaped track attached within a frontal part of said housing, a pair of tambour-type panels carried by said track, a motor operatively coupled to each tambour-type panel to move said panels from side locations out of the path of the light to frontal locations in the path of light and adjacent the opening in the housing, said motor further being operative to move each said tambour-type panel in a forwardly direction toward the front of the housing and then around curved portions of said U-shaped track so that leading edges of each said panel approach each other in the path of light to thereby diffuse the light carried in the light path, said motor being further operative to move the leading edges of each said panel to achieve any one of a plurality of desired spaces therebetween and thus achieve a desired degree of light diffusion.

26. The system of claim 25, wherein said track has a frontal portion thereof in which the tambour-type panels can be moved to overlap so that light carried in the path passes through each said panel for increased diffusion of the light.

27. The system of claim 25, wherein each said panel has varying degrees of diffusivity on surface areas thereof so that when said panels are moved in overlapping positions, areas of low diffusivity of one panel are aligned in a light path with areas of high diffusivity of the other panel.

28. The system of claim 25, further including a pan and tilt mechanism for moving the housing so that diffused light can be directed in a desired direction.

* * * * *

UNITED STATES PATENT AND TRADEMARK OFFICE

CERTIFICATE OF CORRECTION

PATENT NO. : 4,972,306

DATED : November 20, 1990

INVENTOR(S) : James M. Bornhorst

It is certified that error appears in the above-identified patent and that said Letters Patent is hereby corrected as shown below:

Column 1, line 24, "dowsers" should be --dousers--;
Column 1, line 47, "product" should be --produce--;
Column 2, lines 37-38, "leading of" should be --leading edge of--;
Column 5, line 11, "or" should be --of--;
Column 5, line 15, "tracks" should be --tracks.--.

Column 9:

Claim 2, line 8, "thereof" should be --thereon--;

Column 10:
Claim 16, line 1, "14" should be --15--.
Claim 17, line 4, "bu" should be --but--.

Signed and Sealed this

Twenty-third Day of March, 1993

*Attest:*

STEPHEN G. KUNIN

*Attesting Officer*

*Acting Commissioner of Patents and Trademarks*